US005974715A

United States Patent [19]

Werner et al.

[11] Patent Number: 5,974,715

[45] Date of Patent: Nov. 2, 1999

[54] ARTICLE FOR FRAMING A VISUAL WORK

[75] Inventors: Richard S. Werner, 326 Cedar Sauk Rd., West Bend, Wis. 53095; Carey P. Woods, Plum City, Wis.

[73] Assignee: Richard S. Werner, West Bend, Wis.

[21] Appl. No.: 09/022,783

[22] Filed: Feb. 12, 1998

[51] Int. Cl.[6] ..... G09F 1/12

[52] U.S. Cl. ..... 40/772; 40/776

[58] Field of Search ..... 40/537, 661, 701, 40/703, 710, 765, 772, 775, 776, 594

[56] References Cited

U.S. PATENT DOCUMENTS

| | | | |
|---|---|---|---|
| 2,092,348 | 9/1937 | Cross | 40/765 |
| 2,181,874 | 12/1939 | Cross | 40/765 |
| 3,280,493 | 10/1966 | Newman | 40/772 X |
| 3,341,961 | 9/1967 | Shanks . | |
| 3,390,474 | 7/1968 | Wright | 40/701 |
| 3,687,770 | 8/1972 | Chase . | |
| 3,707,053 | 12/1972 | Itano . | |
| 3,810,566 | 5/1974 | Adams et al. | 40/772 X |
| 3,987,569 | 10/1976 | Chase . | |
| 4,711,347 | 12/1987 | Drexler et al. | 40/661 X |
| 4,741,119 | 5/1988 | Baryla . | |
| 4,777,746 | 10/1988 | Brooks . | |
| 4,809,451 | 3/1989 | Suzuki | 40/772 |
| 5,025,581 | 6/1991 | Polzin | 40/776 |
| 5,161,827 | 11/1992 | Grosso | 40/661 X |
| 5,328,729 | 7/1994 | Lamonte, Jr. . | |
| 5,364,671 | 11/1994 | Gustafson . | |
| 5,568,210 | 10/1996 | Kiehne et al. | 40/701 X |

*Primary Examiner*—Brian K. Green
*Attorney, Agent, or Firm*—Jansson, Shupe, Bridge & Munger, Ltd.

[57] ABSTRACT

An article for framing a visual work includes a framing member, the rear surface of which has first and second adhesive portions. A transparent sheet adheres to the first portion and a bifurcated cling film adheres to the second adhesive portion. A pocket is formed between the sheet and the film for receiving the visual work. A method for making an article for framing a visual work includes providing a framing member having a rear surface and adhering a transparent sheet on the first adhesive portion of such surface. A cling film is mounted on a second adhesive portion of the rear surface and in a manner such that the cling film overlays the transparent sheet. The cling film is bifurcated by slitting it, thereby providing an access slot for inserting the visual work between the sheet and the film.

6 Claims, 2 Drawing Sheets

ARTICLE FOR FRAMING A VISUAL WORK

FIELD OF THE INVENTION

This invention relates generally to card, picture and sign exhibiting and, more particularly, to picture frames.

BACKGROUND OF THE INVENTION

It is common to employ articles of any of many available types to display and protect visual works such as art, pictures, photographs, certificates and the like. Perhaps traditional picture frames are the most common articles used for these purposes. The reasons people display visual works are equally varied. They are reminders of personal successes, loved ones or past events which are pleasurable to recall.

With the already-substantial and growing popularity of photography, it is increasingly common for people to display postcards and informal candid photos of friends, pets, or scenery and to change the displayed work with some frequency. Not all articles used for such purposes are configured with frequency of change and ease-of-use in mind.

For example, U.S. Pat. No. 3,341,961 (Shanks) discloses a picture frame in which a picture is retained by adhesive applied to the rear side of the frame. Whenever adhesive is used and a picture retained thereby is removed, there is a possibility that adhesive will stick to the displayed surface of the picture. If the adhesive is very "aggressive," there is even the possibility that attempted removal will tear the picture. In addition, positioning the picture may be more difficult when adhesive retention is used. And the frame disclosed in the Shanks patent includes no overlay to protect the front of the picture.

The picture mount disclosed in U.S. Pat. No. 3,987,569 (Chase) also uses adhesive to secure a picture. The mount incorporates a feature whereby the picture may be properly aligned before securing it to the adhesive.

A type of picture mount is disclosed in U.S. Pat. No. 3,707,053 (Itano) and includes a rigid front panel made of, e.g., glass, and an apertured panel behind the front panel to receive a picture. A back panel cooperates with the other panels and "captures" the picture therebetween. Stud-like connectors are used to hold the assembly together. The mount totally protects the picture at the front, rear and sides. While this mount is probably satisfactory for its intended purpose, it seemingly would have a cost (and therefore selling price) which is unacceptably high for casual purchase and casual display of visual works.

A framing article and method which address shortcomings and disadvantages of the prior art would be an important advance in the field.

OBJECTS OF THE INVENTION

An object of the invention is to provide a new framing article and method which address problems and shortcomings of the prior art.

Another object of the invention is to provide a new method for making a framing article.

Yet another object of the invention is to provide a new framing article suitable (in both cost and ease of use) for casual display of visual works.

Another object of the invention is to provide a new framing article which avoids damaging the displayed work.

Still another object of the invention is to provide a new framing article which permits easy exchange of the work displayed in it. How these and other objects are accomplished will become apparent from the following descriptions of the invention and from the drawings.

SUMMARY OF THE INVENTION

The invention involves both an article for framing a visual work and a related method for making the article. The article is described first.

The article includes a substantially planar framing member made of paperboard stock or the like and having front and rear surfaces. The rear surface (most preferably, the entirety of such surface) is coated with a double-stick adhesive. That area of adhesive to which a transparent sheet adheres is identified as the first adhesive portion while the remaining area which is free of transparent sheet (and which receives the cling film described below) is identified as the second adhesive portion.

Most preferably, the transparent sheet which adheres to the first adhesive portion is untreated polypropylene sheet having an exemplary thickness of 1.5 to 2.0 mils or so. However, sheet thickness is discretionary so long as it has sufficient film strength to be handled as described herein and sufficient transparency to permit the framed visual work to be seen with ease.

A bifurcated cling film adheres to the second adhesive portion and forms a pocket between the sheet and the film for receiving the visual work in it. Bifurcation of the cling film results in first and second film components which are individually removable from the second adhesive portion by lifting each or both components away from such portion. Lifting one or both components "opens the pocket," thereby permitting placement of the visual work between the cling film and the transparent sheet.

When the film is bifurcated as, for example, by slitting, each of the film components has an edge substantially abutting the edge of the other film component. In a highly preferred embodiment, the abutting edges are in registry with the transparent sheet and in registry with the viewing aperture of the framing member. One preferred cling film is static cling polyvinyl chloride (PVC) film.

Another aspect of the invention involves a method for making an article for framing a visual work. The method includes providing a framing member having a rear surface and adhering a transparent sheet on a first adhesive portion of the rear surface. A cling film is mounted on a second adhesive portion of the rear surface and forms an overlay with respect to the transparent sheet. The cling film is then bifurcated, thereby providing an access slot for inserting the visual work between the sheet and the film.

In more specific aspects of the method, the adhering step is preceded by the step of applying a double-stick adhesive to the rear surface, most preferably to the entirety of such rear surface. The providing step includes forming a non-apertured framing blank, applying a double-stick adhesive to the rear surface of the blank, masking the adhesive with a release covering and cutting a central panel from the framing blank, thereby forming a framing member having a viewing aperture. The release covering is then removed from the framing member.

In yet other specific aspects of the method, the cling film is covered by a release layer and the bifurcating step includes simultaneously slitting the release layer and the cling film. The slitting step is followed by the step of removing the release layer from the cling film.

Bifurcation divides the cling film into first and second components. The method also includes steps for framing the visual work and those steps include lifting at least one of the components away from the transparent sheet. Most preferably, the lifting step includes lifting both components away from the transparent sheet.

One variant of the method contemplates that the transparent sheet and the cling film will be applied to the framing member in sequence and in that order. In another variant, the adhering step is preceded by the step of placing the transparent sheet and the cling film against one another and affixed to one another (by fusing, glueing or the like) to form what might be termed a pouch. Thereafter, the transparent sheet and the cling film are mounted at once to the framing member. That is, the adhering step and the mounting step occur substantially simultaneously.

In another aspect of the method, the cling film and/or the transparent sheet are trimmed to be in registry with the framing member. As and if needed, such trimming makes the article more aesthetically appealing.

Other details of the invention are set forth in the following detailed description and in the drawings.

DETAILED DESCRIPTION OF PREFERRED EMBODIMENTS

Figure 2:
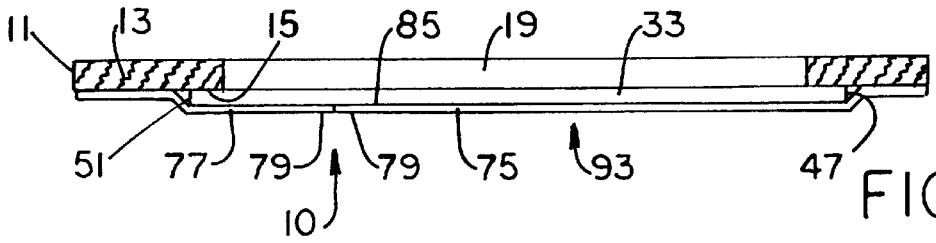
FIG. 2 is a section view of the article of FIG. 1 taken along the viewing plane 2—2 thereof.
Figure 1:
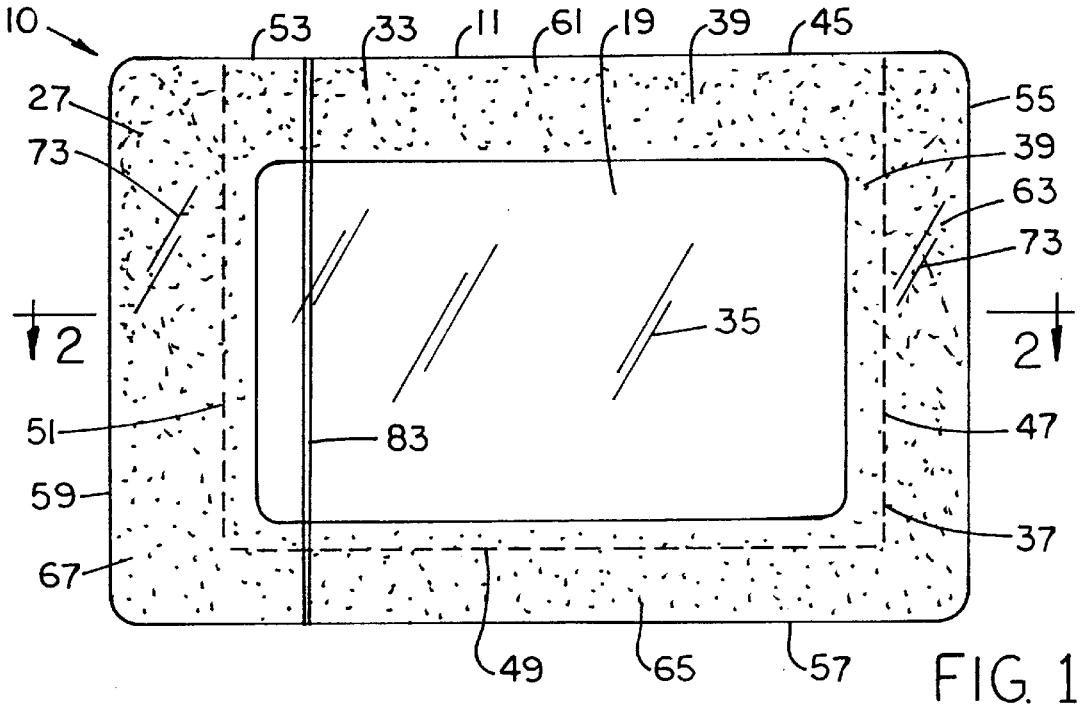
FIG. 1 is an elevation view of the rear side of the new framing article.
Figure 4:
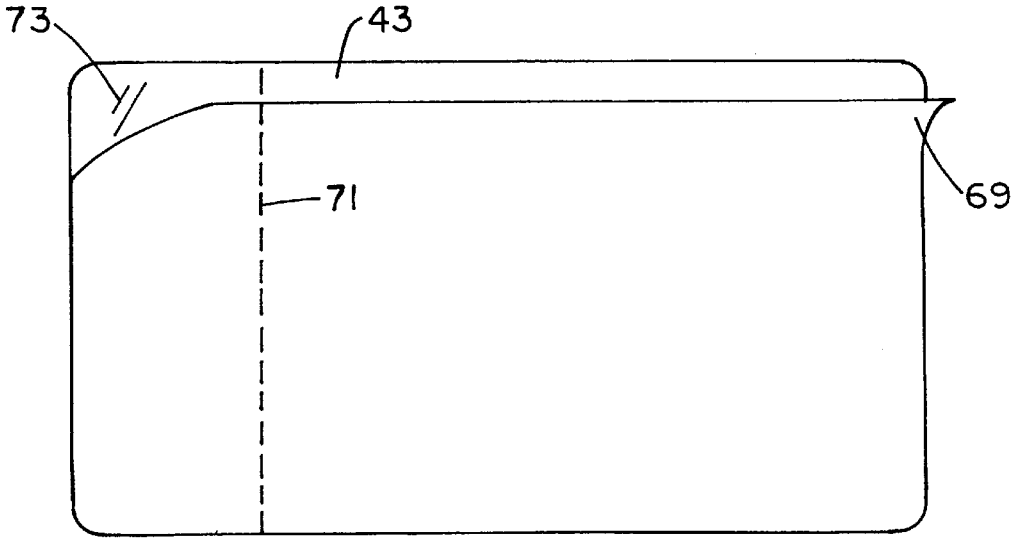
FIG. 4 is an elevation view of a sheet of cling film with a release layer partially lifted away therefrom.
Figure 3:
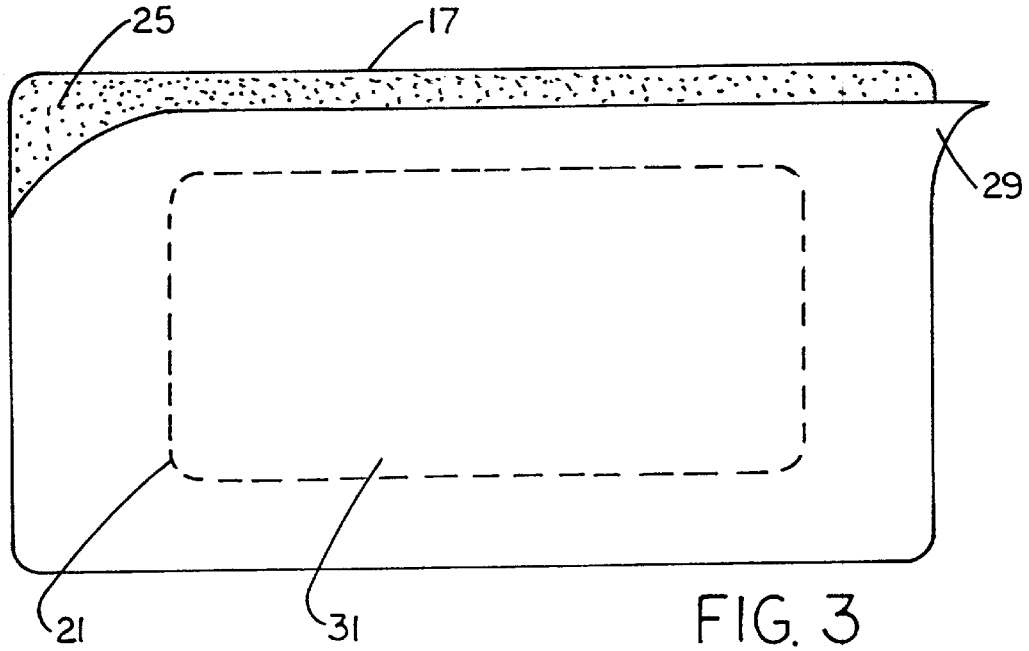
FIG. 3 is an elevation view of a piece of framing stock with adhesive applied thereto and with a release covering partially lifted away therefrom.

Referring first to FIGS. 1, 2, and 3, the new article 10 for framing a visual work includes a substantially planar framing member 11 made of paperboard stock or the like. The framing member 11 has a front surface 13 and a rear surface 15 and is formed from framing stock 17 which, prior to cutting, has no viewing aperture 19 in it. Such stock 17 is shown in FIG. 3 and the dashed line 21 marks the boundary of the aperture 19 after cutting. As noted below, such dashed line 21 also marks the boundary of a panel.

Most preferably, the rear surface 25 of the stock 17 is coated with a double-stick adhesive 27 as represented by the stippling in FIG. 1. Prior to cutting by, e.g., die cutting, the rear surface 25 and the adhesive 27 thereon are masked with a release covering 29 such as a thin sheet of paper. A central panel 31 is cut from the stock 17, thereby forming the framing member 11 having the viewing aperture 19. The remaining release covering 29 adhering to the framing member 11 is then removed.

Referring particularly to FIG. 2, a transparent sheet 33 such as a polypropylene sheet is adhered to the framing member 11 by applying it to the adhesive 27. The transparency of such sheet 33 is represented by the hash marks 35 in registry with the aperture 19 in FIG. 1. That area of adhesive 27 to which the transparent sheet 33 adheres, marked by the dashed line 37, is identified as the first adhesive portion 39. The remaining area which is free of transparent sheet 33 (and which receives the cling 43 film described below) is identified as the second adhesive portion 41.

Considering FIGS. 1 and 2, the area and dimensions of the sheet 33 with respect to those of the framing member 11 are to be noted. Also to be noted is the placement of such sheet 33 on such member 11. More specifically, the sheet 33 has edges 45, 47, 49 and 51. The framing member 11 has boundary edges 53, 55, 57 and 59. The edge 45 of the sheet 33 is in registry with the edge 53 of the member 11 while the edges 47, 49 and 51 of the sheet 33 are spaced inwardly from the respective edges 55, 57 and 59 of the member 11. Therefore, the sheet 33 entirely covers the adhesive 27 in the region 61 but leaves adhesive exposed in the regions 63, 65 and 67. The reasons for this arrangement are explained below.

Referring next to FIGS. 2, 3, 4 and 5, a sheet of transparent cling film 43 has a release layer 69, e.g, a thin sheet of paper. With the release layer 69 attached, the film 43 is applied to the second adhesive portion 41 at the regions 63, 65 and 67 is also applied to the transparent sheet 33 in the region 61. After such application, the film 43 is bifurcated by slitting the release layer 69 and the film 43 (but not the transparent sheet 33) simultaneously. Slitting is preferably along a straight line represented by the dashed line 71 in FIG. 4. In a specific embodiment, the line 71 is parallel to the edges 47, 51 and the edges 55, 59, and perpendicular to the edges 45, 49, and to the edges 53, and 57. Transparency of the film 43 is represented by the hash marks 73 in FIGS. 1 and 4.

Figure 5:
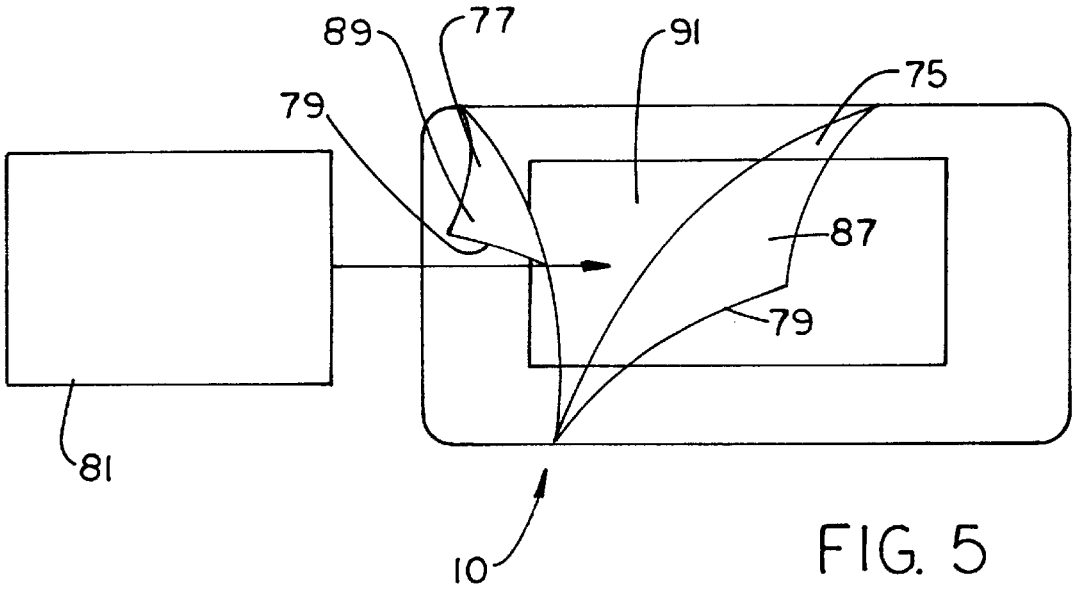
FIG. 5 is an elevation view of the new article showing how a visual work is mounted therein.

Referring particularly to FIGS. 1 and 5, when the film 43 is bifurcated, each of the film components 75, 77 has an edge 79 substantially abutting the edge 79 of the other film component 77, 75. In a highly preferred embodiment, the abutting edges 79 are in registry with the transparent sheet 33 and in registry with the viewing aperture 19 of the framing member 11. While it is possible to insert the visual work 81 through the access slot 83 between the edges 79, such work 81 is more conveniently framed as described below.

The now-bifurcated cling film 43 adheres to the second adhesive portion 41 and forms a very thin pocket between the sheet 33 and the film 43 at the location 85 for receiving the visual work 81 in it. Bifurcation of the cling film 43 results in first and second film components 75, 77 respectively, which are individually removable from the second adhesive portion 41 and from the region 61. Component removal is, for example, by lifting the corner 87 of the component 75 and/or the corner 89 of the component 77. When the corner(s) 87, 89 and the components 75, 77, are lifted partially away, the thin pocket 91 at location 85 is opened and the visual work 81 may be placed edgewise between the cling film 43 and the transparent sheet 33. After the work 81 is so placed and "squared" with respect to the framing member 11, the components 75, 77 are restored to the positions shown in FIG. 2. The components 75, 77 may be made to again adhere to the second adhesive portion 41 and to the transparent sheet 33 along the region 61 by burnishing the components 75, 77 over the portion 41 and the region 61. (It is no doubt apparent that in the view of FIG. 5, the display surface of the work 81, e.g., the image of a photo, is away from the viewer.)

One way to make the article 10 is to apply the transparent sheet 33 and the cling film 43 to the framing member 11 in sequence and in that order. Another way is to place the sheet 33 and the cling film 43 against one another and join them along plural edges to form a pouch 93 as indicated in FIG. 2. (Such pouch 93 would be comprised of the film 43 prior to slitting.)

After the pouch 93 is formed, the transparent sheet 33 and the cling film 43 are mounted to the framing member 11 substantially simultaneously. Irrespective of which variant of the method is followed to make the article 10, the cling film 43 and/or the transparent sheet 33 may overhang any one or more of the edges 53, 55, 57 or 59 of the framing member 11. The film 43 and/or sheet 33 are preferably trimmed to be in registry with the framing member 11.

The new framing article 10 facilitates protectively "encapsulating" a visual work and is highly versatile in use. As examples, the article 10 may be tacked to a wall, retained by double-sided tape on a door or, on many surfaces, retained by the cling film 43. And magnetic tape may also be used for mounting the article 10.

As used herein, the term "double-stick adhesive" means any adhesive product which adheres to the rear surface of the framing stock 17 and which presents an exposed adhesive surface to the transparent sheet 33 and the cling film 43. Examples of double-stick adhesive include double-sided tape, adhesive film, hot melt and adhesive droplets.

The term "visual work" means any object which is perceived visually. Examples of visual works 81 include award certificates, picture postcards and photographs.

Terms such as "front" surface and "rear" surface are from the perspective of a viewer looking at the visual work 81 displayed in the Article 10. In terms of proximity to such a viewer, a front surface is closer than a rear surface.

While the principles of the invention have been shown and described in connection with a few preferred embodiments, it is to be understood clearly that such embodiments are by way of example and are not limiting.

What is claimed:

1. An article for framing a visual work including:

a framing member having a rear surface with top, bottom, and opposed side edges;

a first adhesive portion directly on the rear surface and spaced inwardly from the bottom and side edges and extending along the top edge;

a second adhesive portion directly on the rear surface and extending along three of the said top, bottom and opposed side edges;

a transparent sheet adhering to the first adhesive portion;

a cling film having a slit for bifurcating the cling film, the cling film in registry with all four edges of the framing member and adhering to the second adhesive portion, thereby forming a pocket between the sheet and the film for receiving the visual work therein.

2. The article of claim 1 wherein the first and second adhesive portions are formed by a double-stick adhesive on the rear surface.

3. The article of claim 2 wherein the cling film includes first and second film components removable from the second adhesive portion, thereby permitting placement of the visual work between the cling film and the transparent sheet.

4. The article of claim 3 wherein each of the film components has an edge substantially abutting the edge of the other film component.

5. The article of claim 4 wherein the abutting edges are in registry with the transparent sheet.

6. The article of claim 5 wherein:

the frame has a viewing aperture; and the abutting edges are in registry with the viewing aperture.

* * * * *